US011107493B2

(12) United States Patent
Mainiero et al.

(10) Patent No.: US 11,107,493 B2
(45) Date of Patent: Aug. 31, 2021

(54) SOUND EVENT DETECTION

(71) Applicant: Cirrus Logic International Semiconductor Ltd., Edinburgh (GB)

(72) Inventors: Sara Mainiero, Edinburgh (GB); Toby Stokes, Edinburgh (GB); Pablo Peso Parada, Edinburgh (GB); Rahim Saeidi, Edinburgh (GB)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 16/566,162

(22) Filed: Sep. 10, 2019

(65) Prior Publication Data

US 2020/0105293 A1 Apr. 2, 2020

Related U.S. Application Data

(60) Provisional application No. 62/738,126, filed on Sep. 28, 2018.

(51) Int. Cl.

| | |
|---|---|
| ***G10L 25/51*** | (2013.01) |
| ***G10L 25/18*** | (2013.01) |
| ***G10L 25/21*** | (2013.01) |

(52) U.S. Cl.

CPC ..... *G10L 25/51* (2013.01); *G10L 25/18* (2013.01); *G10L 25/21* (2013.01)

(58) Field of Classification Search

CPC ..... G10L 25/21; G10L 25/51; G10L 25/18; G10L 25/04; G10L 25/0272; G10L 15/04

USPC .... 381/56–67, 110; 704/205, 235, 256, 251, 704/202

See application file for complete search history.

(56) References Cited

U.S. PATENT DOCUMENTS

| | | | | |
|---|---|---|---|---|
| 10,311,872 | B2 * | 6/2019 | Howard | G10L 15/22 |
| 10,679,646 | B2 * | 6/2020 | Komatsu | G10L 21/0308 |
| 2012/0143610 | A1 | 6/2012 | Wang et al. | |
| 2012/0209612 | A1 * | 8/2012 | Bilobrov | G10L 25/54 704/270 |
| 2015/0139445 | A1 | 5/2015 | Kitazawa | |
| 2016/0241346 | A1 | 8/2016 | Hoffman | |
| 2017/0103748 | A1 | 4/2017 | Weissberg et al. | |
| 2017/0270945 | A1 | 9/2017 | Dimitriadis et al. | |
| 2018/0254050 | A1 | 9/2018 | Tashev et al. | |
| 2019/0035390 | A1 * | 1/2019 | Howard | G10L 15/30 |
| 2019/0251988 | A1 * | 8/2019 | Komatsu | G10L 15/10 |
| 2020/0074982 | A1 * | 3/2020 | McCallum | G10L 15/063 |

OTHER PUBLICATIONS

International Search Report and Written Opinion of the International Searching Authority, International Application No. PCT/GB2019/052461, dated Oct. 18, 2019.

Dennis, J. et al., Overlapping Sound Event Recognition Using Local Spectrogram Features and the Generalised Hough Transform, Pattern Recognition Letters, Elsevier, Amsterdam, NL, vol. 34, No. 9, Mar. 14, 2013, pp. 1085-1092.

Combined Search and Examination Report under Sections 17 and 18(3), UKIPO, Application No. dated Apr. 11, 2019.

* cited by examiner

*Primary Examiner* — Disler Paul

(74) *Attorney, Agent, or Firm* — Jackson Walker L.L.P.

(57) ABSTRACT

An audio processing system is described for an audio event detection (AED) system. The system includes a feature extraction block configured to derive at least one feature which represents a spectral feature of the input signal.

18 Claims, 8 Drawing Sheets

| | | |
|---|---|---|
| X1 | X2 | Frame 1 |
| X2 | X3 | Frame 2 |
| X3 | X4 | Frame 3 |
| X4 | X5 | Frame 4 |
| X5 | X6 | Frame 5 |
| X6 | X7 | Frame 6 |
| X7 | X8 | Frame 7 |
| X8 | X9 | Frame 8 |
| X9 | X10 | Frame 9 |
| X10 | X11 | Frame 10 |

Fig. 6A

| Filter Bank | 1 | 2 | 3 | 4 | 5 | 6 | 7 | 8 | 9 | 10 |
|---|---|---|---|---|---|---|---|---|---|---|
| 1 | Sum FFT -samples 1 to 18 | Sum FFT -samples 1 to 18 | Sum FFT -samples 1 to 18 | Sum FFT -samples 1 to 18 | Sum FFT -samples 1 to 18 | Sum FFT -samples 1 to 18 | Sum FFT -samples 1 to 18 | Sum FFT -samples 1 to 18 | Sum FFT -samples 1 to 18 | Sum FFT -samples 1 to 18 |
| 2 | Sum FFT -samples 19 to 36 | Sum FFT -samples 19 to 36 | Sum FFT -samples 19 to 16 | Sum FFT -samples 19 to 16 | Sum FFT -samples 19 to 16 | Sum FFT -samples 19 to 16 | Sum FFT -samples 19 to 16 | Sum FFT -samples 19 to 16 | Sum FFT -samples 19 to 16 | Sum FFT -samples 19 to 16 |
| 3 | Sum FFT -samples 37 to 54 | Sum FFT -samples 37 to 54 | Sum FFT -samples 37 to 54 | Sum FFT -samples 37 to 54 | Sum FFT -samples 37 to 54 | Sum FFT -samples 37 to 54 | Sum FFT -samples 37 to 54 | Sum FFT -samples 37 to 54 | Sum FFT -samples 37 to 54 | Sum FFT -samples 37 to 54 |
| 4 | Sum FFT -samples 55 to 72 | Sum FFT -samples 55 to 72 | Sum FFT -samples 55 to 72 | Sum FFT -samples 55 to 72 | Sum FFT -samples 55 to 72 | Sum FFT -samples 55 to 72 | Sum FFT -samples 55 to 72 | Sum FFT -samples 55 to 72 | Sum FFT -samples 55 to 72 | Sum FFT -samples 55 to 72 |
| | - - - | - - - | - - - | - - - | - - - | - - - | - - - | - - - | - - - | - - - |
| 40 | Sum FFT -samples 703 to 720 | Sum FFT -samples 703 to 720 | Sum FFT -samples 703 to 720 | Sum FFT -samples 703 to 720 | Sum FFT -samples 703 to 720 | Sum FFT -samples 703 to 720 | Sum FFT -samples 703 to 720 | Sum FFT -samples 703 to 720 | Sum FFT -samples 703 to 720 | Sum FFT -samples 703 to 720 |

Frame Index

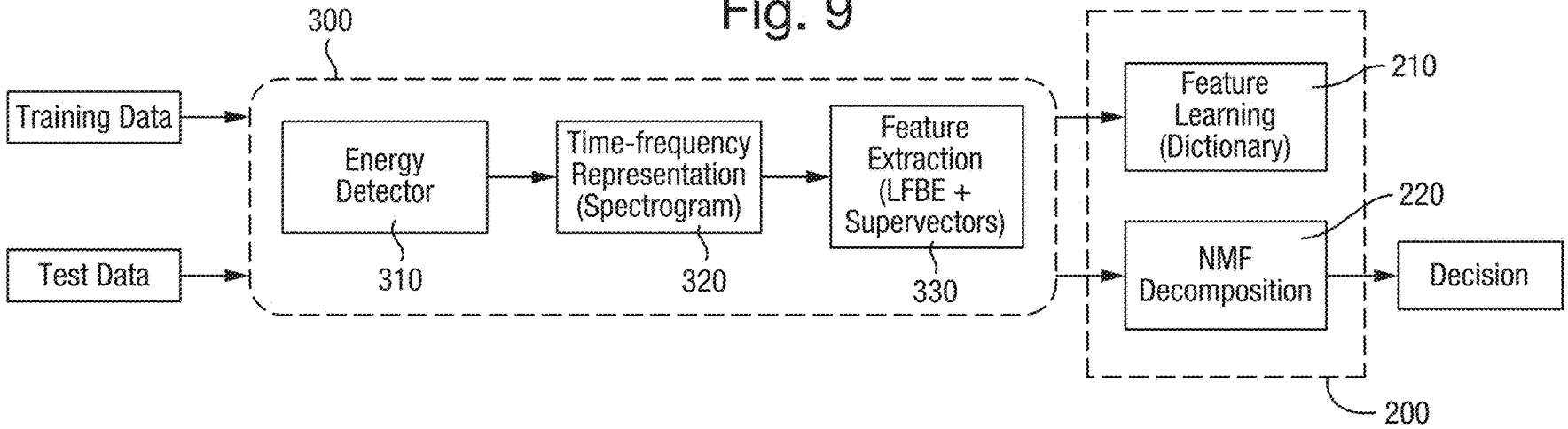
Fig. 9
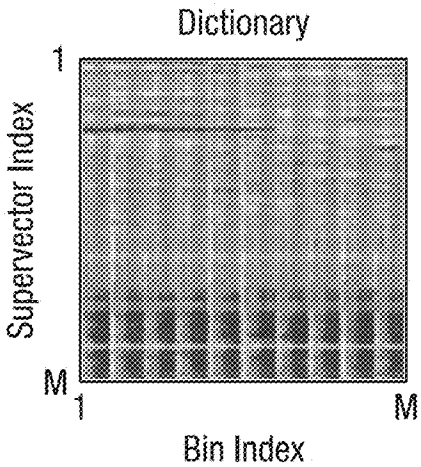
Fig. 10A
Fig. 10B
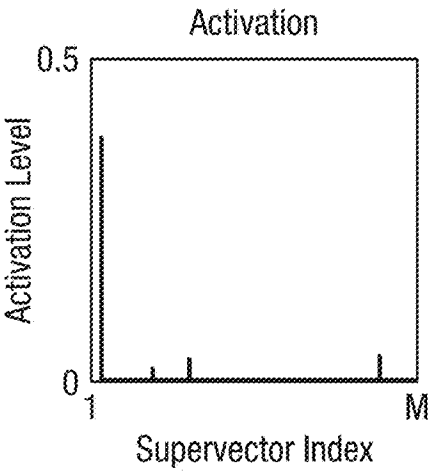
Fig. 10C

SOUND EVENT DETECTION

The present disclosure claims priority to U.S. Provisional Patent Application Ser. No. 62/738,126, filed on Sep. 28, 2018 which is incorporated by reference herein in its entirety.

TECHNICAL FIELD

The present application relates to methods, apparatuses and implementations concerning or relating to audio event detection (AED).

BACKGROUND

Sound event detection can be utilised in a variety of applications including, for example, context-based indexing and retrieval in multimedia databases, unobtrusive monitoring in health care and surveillance. Audio Event Detection has numerous applications within a user device. For example, a device such as a mobile telephone or smart home device may be provided with an AED system for allowing a user to interact with applications associated with the device using certain sounds as a trigger. For example, an AED system may be operable to detect a hand clap and to output a command which initiates a voice call being placed to a particular person.

Known AED systems involve the classification and/or detection of acoustic activity related to one or more specific sound events. For example, AED systems are known which involve processing an audio signal representing e.g. an ambient or environmental audio scene, in order to detect and/or classify sounds using labels that people would tend to use to describe a recognizable audio event such as, for example, a handclap, a sneeze or a cough.

A number of AED systems have been previously proposed which may rely upon algorithms and/or "machine listening" systems that are operable to analyse acoustic scenes. The use of neural networks is becoming increasingly common in the field of audio event detection. However, such systems typically require a large amount of training data in order to train a model which seeks to recreate the process that is happening in the brain in order to perceive and classify sounds in the same manner as a human being would do.

The present aspects relate to the field of Audio Event Detection and seek to provide an audio processing system which improves on the previously proposed systems.

SUMMARY

According to an example of a first aspect there is provided an audio processing system for an audio event detection (AED) system, comprising:

an input for receiving an input signal, the input signal representing an audio signal;

a feature extraction block configured to derive at least one feature which represents a spectral feature of the input signal.

The feature extraction block may be configured to derive the at least one feature by determining a measure of the amount of energy in a given frequency band of the input signal. The feature extraction block may comprise a filter bank comprising a plurality of filters. The plurality of filters may be spaced according to a mel-frequency scale. The feature extraction block may be configured to generate, for each frame of the audio signal, a feature matrix representing the amount of energy in each of the filters of the filter bank.

According to one or more examples the feature extraction block may be configured to concatenate each of the feature matrices in order to generate a supervector corresponding to the input signal. The supervector may be output to a dictionary and stored in memory associated with the dictionary.

According to at least one example the audio processing system further comprises: a classification unit configured to compare the at least one feature derived by the feature extraction unit with one or more stored elements of a dictionary, each stored element representing one or more previously derived features of an audio signal derived from a target audio event. The classification unit may be configured to determine a proximity metric which represents the proximity of the at least one feature derived by the feature extraction unit to one or more of the previously derived features stored in the dictionary. The classification unit may be configured to perform a method of non-negative matrix factorisation (NMF) wherein the input signal is represented by a weighted sum of dictionary features (or atoms). The classification unit may be configured to derive or update one or more active weights, the active weight(s) being a subset of the weights, based on a determination of a divergence between a representation of the input signal and a representation of a target audio event stored in the dictionary.

According to one or more examples the audio processing system may further comprise a classification unit configured to determine a measure of a difference between the supervector and a previously derived supervector corresponding to a target audio event. If the measure of the difference is below a predetermined threshold, the classification unit may be operable to output a detection signal indicating that the target audio event has been detected. For example, the detection signal comprises a trigger signal for triggering an action by an applications processor of the device.

According to at least one example, the audio processing system further comprises a frequency representation block for deriving a representation of the frequency components of the input signal, the frequency representation block being provided at a processing stage ahead of the feature extraction block. For example, the frequency representation or visualisation comprises a spectrogram.

According to at least one example the audio processing system further comprises an energy detection block, the energy detection block being configured to receive the input signal and to carry out an energy detection process, wherein if a predetermined energy level threshold is exceeded, the energy detection block outputs the input signal, or a signal based on the input signal, in a processing direction towards the feature extraction unit.

According to an example of a second aspect there is provided a method of training a dictionary comprising a representation of a one or more target audio events, comprising:

each frame of a signal representing an audio signal comprising a target audio event, extracting one or more spectral features, compiling a representation of the spectral features derived for a series of frames and storing the representation in memory associated with a dictionary.

The representation may comprise, for example, at least one feature matrix. The representation may comprise a supervector.

According to at least one example there is provided an audio processing system comprising an input for receiving an input signal, the input signal representing an audio signal, and a feature extraction block configured to determine a measure of the amount of energy in a portion of the input signal, and to derive a matrix representation of the portion of the audio signal, wherein each entry of the matrix comprises the energy in a given frequency band for a given frame of the portion of the input signal, and to concatenate the rows or columns of the matrix to form a supervector, the supervector being a vector representation of the portion of the audio signal. In this way, according to at last one example, an audio processing system is configured to derive a vector representation of at least a portion of the audio signal. As will be explained with reference to some examples below, the portion of the audio signal may correspond to a frame of the input signal. In some examples, the input signal may be divided into a plurality of frames and the audio processing system is configured to derive a vector representation of each frame of the input signal (e.g. by dividing each frame into sub-frames).

The feature extraction block may further comprise a filter bank comprising a plurality of filters, each filter in the filter bank being configured to determine an energy of at least a portion of the input signal in a given frequency range; and each entry of the matrix may comprise the energy in a frequency band according to a given filter in the filter bank for a given frame of the input signal.

The audio processing system may further comprise an energy detection block configured to process the input signal into a plurality of frames. For example, the energy detection block may be configured to process the input signal into a plurality of frames having a half-frame overlap, so that each frame in the plurality except the first frame and the last frame comprises the second half of the previous frame and the first half of the next frame; and each entry of the matrix may comprises the energy in a given frequency band for a given frame of the plurality of frames of the input signal.

The audio processing system may further comprise an energy detection block configured to process the input signal into L frames. For example, the energy detection block may be configured to process the input signal into L frames having a half-frame overlap, so that each frame in the plurality except the first frame and the last frame comprises the second half of the previous frame and the first half of the next frame; and the feature extraction block may further comprise a filter bank comprising N filters, each filter in the filter bank being configured to determine an energy of at least a portion of the input signal in a given frequency range; and the matrix derived by the feature extraction block may comprise an N×L matrix whose (i,j)th entry comprises the energy of the jth frame in the frequency band defined by the ith filter in the filterbank, and wherein the feature extraction block is configured to concatenate the rows of the matrix to form the supervector.

The audio processing system may further comprise an energy detection block configured to process the input signal into L frames. For example, the energy detection block may be configured to process the input signal into L frames having a half-frame overlap, so that each frame in the plurality except the first frame and the last frame comprises the second half of the previous frame and the first half of the next frame; and the feature extraction block may further comprise a filter bank comprising N filters, each filter in the filter bank being configured to determine an energy of at least a portion of the input signal in a given frequency range; and the matrix derived by the feature extraction block may comprise an L×N matrix whose (i,j)th entry comprises the energy of the ith frame in the frequency band defined by the jth filter in the filterbank, and wherein the feature extraction block is configured to concatenate the columns of the matrix to form the supervector.

In one example, therefore, the rows of the derived matrix are concatenated to form the supervector and in another example, the columns of the derived matrix are concatenated to form the supervector. In either example, however, the filter bank energies are concatenated for all frames. In other words, in either example, the supervector comprises all filter bank energies for the first frame, then all filter bank energies for the second frame, etc. The filter bank energies may be in increasing order of the frequency range defined by each filter. For example, the plurality of filters may comprise a first filter and a second filter etc. The second filter may define an increased frequency range relative to the first (for example the frequency defining the lower bound of the frequency range of the second filter may be greater than the frequency defining the lower bound of the frequency range of the first filter, etc., and/or the frequency defining the upper bound of the frequency range of the first filter may be less than the frequency defining the upper bound of the frequency range of the second filter, etc.). In such examples the supervector comprises the filter bank energy of the first filter for the first frame, then the second filter for the first frame, etc., for all filters before comprising the energy of the first filter for the second frame, then the second filter for the second frame, etc. for all filters and for all frames.

Concatenation, as used herein, may therefore be understood to mean at least one of: link together, for example in a chain or series, or place end-to-end. For example, concatenating two rows may comprise placing one row after the other and may comprise placing the second row after the first etc. Therefore, concatenating the rows or columns of the derived matrix to form the supervector may result in supervector comprising the filterbank energies for each filter, for each frame.

The resulting process is a vector representation of the portion of the input signal. As will be described below with reference to some examples it may be determined, from this vector representation, if the portion of the input signal corresponds to a known sound and/or if the audio signal can therefore be identified as a known sound.

The audio processing system may further comprise an energy detection block configured to process the input signal into a plurality of frames, and to process each frame into a plurality of sub-frames; and the feature extraction block may be configured to derive a matrix representation of the audio signal for each frame, wherein, for each frame, each entry of the matrix comprises the energy in a given frequency band for a given sub-frame of the input signal, and to concatenate the rows or columns of each matrix to form a supervector, the supervector being a vector representation of the frame of the audio signal.

In these examples, the input signal representing the audio signal is split into a plurality of frames and a supervector is obtained for each frame of the input signal, by splitting each frame into sub-frames and forming a supervector whose entries are the filterbank energies for each sub-frame of the frame of the input signal.

The audio processing system may further comprise an energy detection block configured to process each frame into K sub-frames. For example, the energy detection block may be configured to process each frame into K sub-frames having a half-frame overlap, so that each sub-frame in the plurality except the first sub-frame and the last sub-frame comprises the second half of the previous sub-frame and the first half of the next sub-frame; and the feature extraction block may further comprise a filter bank comprising P filters, each filter in the filter bank being configured to determine an energy of at least a portion of the input signal in a given frequency range; and wherein, for each frame, the matrix derived by the feature extraction block is an P×K matrix whose (i,j)th entry comprises the energy of the jth frame in the frequency band defined by the ith filter in the filterbank, and wherein the feature extraction block is configured to concatenate the rows of the matrix to form the supervector.

The audio processing system may further comprise an energy detection block configured to process each frame into K sub-frames. For example, the energy detection block may be configured to process each frame into K sub-frames having a half-frame overlap, so that each sub-frame in the plurality except the first sub-frame and the last sub-frame comprises the second half of the previous sub-frame and the first half of the next sub-frame; and the feature extraction block may further comprise a filter bank comprising P filters, each filter in the filter bank being configured to determine an energy of at least a portion of the input signal in a given frequency range; and wherein, for each frame, the matrix derived by the feature extraction block is an K×P matrix whose (i,j)th entry comprises the energy of the ith frame in the frequency band defined by the jth filter in the filterbank, and wherein the feature extraction block is configured to concatenate the columns of the matrix to form the supervector.

The audio processing system may further comprise a classification unit configured to determine a measure of difference between the or each supervector and an element stored in a dictionary, the element being stored as a vector representing a known sound event (for example, blow, clap, cough, finger click, knock, etc.). If the measure of difference between a given supervector and a vector in the dictionary representing a known sound event is below a first predetermined threshold, then the classification unit may be configured to output a detection signal indicating that the known sound event has been detected for the portion of the input signal corresponding to the given supervector. In these examples, the audio processing system may comprise a classification unit configured to determine how different the supervector is from a stored vector, the stored vector representing a known sound type. Therefore, the classification unit is configured to determine how different the portion of the audio signal represented by the supervector is from a known sound type. If it is determined that the difference is below a predetermined threshold then it is concluded that the portion of the audio signal is similar enough (e.g. not significantly different) or the same, for example within a tolerance, that it is determined that the portion of the audio signal is the known sound type (e.g. blow, clap, cough, etc.).

In one example, if a given number of supervectors for which the measure of difference is below the first predetermined threshold is above a second predetermined threshold, then the classification unit is configured to output a detection signal indicating that the known sound event has been detected for the portion of the input signal corresponding to the given number of supervectors. In this example, it is determined whether the difference measure is low enough for a plurality of supervectors. For example, it may be determined that the difference measure is low enough for every supervector that characterises the input signal.

Therefore, according to one example, a portion of an input signal representing the audio signal is divided into frames and a matrix and supervector is derived for the portion of the input signal as described above. If the measure of difference is low enough (below the first predetermined threshold) between the supervector and a known sound type (e.g. cough, clap, etc.) then it is determined that the portion of the input signal is the known sound type. According to another example, a portion of the input signal representing the audio signal is divided into frames and each frame is divided into sub-frames. A matrix and supervector is derived for each frame, and, if the measure of difference is low enough (below the first predetermined threshold) for each supervector then it is determined that the portion of the input signal is the known sound type. This example may be useful when the input signal is such that forming a single supervector characterising the entire signal could be onerous of the processing capabilities of the audio processing system.

The classification unit may be configured to represent the or each supervector in terms of a weighted sum of elements of a dictionary, each element of the dictionary being stored as a vector representing a known sound event, the dictionary storing the elements as a matrix of vectors, the classification unit thereby being configured to represent the or each supervector as a product of a weight vector and the matrix of vectors. In one example, the dictionary stores m elements as vectors and each vector is n-dimensional. In this example the dictionary comprises a m×1 matrix, with each entry being an n-dimensional vector. In other words, the dictionary may comprise an m×n matrix, with each entry being a number. The classification unit is therefore configured to represent the or each supervector as a vector (dot), or matrix, product of a weight vector and a dictionary vector (or matrix). In examples where the matrix comprises an m×n matrix (as described above) the weight vector is therefore an m-dimensional vector (or a 1×m) matrix and the supervector (derived from the matrix by concatenating its rows or columns) is n-dimensional (or a 1×n matrix). Expressing the supervector as a weighted sum of dictionary elements (vectors) effectively represents the supervector in the "dictionary basis", in other words, the dictionary element vectors may form a vector basis and the supervector may be written in this basis. The coefficients of each basis vector are the entries in the weight vector and may therefore be termed "weights". In some examples, to be described below, these weights are used to classify the audio signal represented by the input signal.

In some examples, vector entries in the dictionary matrix may be grouped according to the type of known sound. For example, a first group of vectors may each describe different types of blow, a second group of vectors may each describe different types of clap, etc. In one example each group may comprise consecutive rows in the matrix. For example, the $1^{st}$-nth rows may comprise vectors that each describe a type of finger click and the nth-mth rows may comprise vectors that each describe a type of knock, etc.

The classification unit may be configured to, for the or each supervector, determine an activated known sound type being the known sound type having the greatest number of vectors having non-zero coefficients when the or each supervector is represented as the weighted sum, the classification unit being configured to sum the coefficients of the vectors in the activated known sound type and compare the sum to a third predetermined threshold, and if the sum is greater than the third predetermined threshold then the classification unit is configured to output a detection signal indicating that the activated known sound type has been detected for the or each supervector. In this example, the classification unit determines that the audio signal represented by the portion of the input signal corresponding to the supervector is a known sound type by determining if the sum of non-zero weights exceeds a predetermined threshold. The region of the dictionary is said to be "activated" if the greatest number of non-zero weights are the coefficients of vectors in this region when the supervector is expressed in the dictionary basis. In other words, when the supervector is written in terms of basis vectors (the elements of the dictionary) the greatest number of non-zero weights may be coefficients for vectors in the "knock" region of the dictionary (e.g. coefficients for vectors in the dictionary describing a knock). In this instance, the portion of the audio signal corresponding to the supervector is identified as a "knock" if the sum of the weights in this region exceed a third predetermined threshold.

In some examples, the classification unit is configured to, for the or each supervector, sum the coefficients of the vectors in each group according to each type of known sound to determine an activated known sound type being the known sound type whose vector coefficients have the highest sum, the classification unit being to compare the sum of the coefficients in the activated known sound type to a fourth predetermined threshold, and if the sum is greater than the fourth predetermined threshold then the classification unit is configured to output a detection signal indicating that the activated known sound type has been detected for the or each supervector. In these examples, if a number of regions of the dictionary matrix correspond to non-zero weights then the activated known sound type (e.g. cough) may be the type of sound corresponding to the region of the dictionary having the highest sum of non-zero weights. Then, the weights in the activated known sound (e.g. cough) type may be summed and, if the sum exceeds a fourth predetermined threshold, then it may be determined that the portion of the audio signal is a cough.

The classification unit may be configured to average the sum of the coefficients of the vectors in an activated known sound type, for each supervector, and to compare the average to a fifth predetermined threshold, wherein, if the average sum is greater than the fifth predetermined threshold then the classification unit is to configured to output a detection signal indicating that the activated known sound type has been detected for the audio signal. In this example, it is determined whether the sum of coefficients for each supervector, on average, are above a fifth predetermined threshold and, is so, then it is determined that the audio signal is the known sound type. In this way, it is determined that the plurality of supervectors, on average, characterise a known type of sound event (e.g. click) and so the audio signal is the sound event (e.g. the click).

In examples described herein where the audio processing system comprises a filterbank, the filterbank may comprise a plurality of filters spaced according to the mel frequency scale. In other examples the filters may be spaced not according to the mel frequency scale. In some examples, the or each supervector may be stored, e.g. in a memory associated with the dictionary. In some examples, the classification unit may be configured to determine a proximity metric which represent the proximity of the supervector to a vector stored in the dictionary. In some examples the input signal may be represented in terms of wavelets and/or a spectrogram however in other examples the "pure signal" (e.g. in the time domain may be used).

In examples where the input signal is divided into frames, a Fourier transform (for example a fast-form Fourier transform or a short-time Fourier transform) may be applied to the or each frame. This will have the effect of converting the or each frame of the input signal into the frequency domain. The or each frame, in the frequency domain, may be utilised by the filterbank to derive the energy of the input signal in the or each frame. In examples where the input signal is divided into sub-frames, a Fourier transform (for example a fast-form Fourier transform or a short-time Fourier transform) may be applied to the or each sub-frame. This will have the effect of converting the or each sub-frame of the input signal into the frequency domain. The or each sub-frame, in the frequency domain, may be utilised by the filterbank to derive the energy of the input signal in the or each sub-frame.

According to another example of the present disclosure there is provided a dictionary comprising a memory storing a plurality of elements, each element representing a sound event, wherein each element is stored in the memory as a vector in a respective row of a matrix, the memory thereby storing the plurality of elements as a matrix of vectors.

The vectors may be grouped in the matrix according to known sound types such that the vectors in a first set of rows in the matrix all correspond to a first sound type and the vectors in a second set of rows correspond to a second sound type. This may be as described above for example a first number of rows may correspond to known clicks, and a second set of rows may correspond to known coughs, etc.

According to another example of the present disclosure there is provided an audio processing module for an audio processing system, the audio processing module being configured to concatenate the rows or columns of a matrix to form a vector, each entry in the matrix representing an energy of a portion of an input signal, the input signal representing an audio signal, in a given frequency range, the vector thereby representing the input signal.

The audio processing module may be configured to represent the vector as a weighted sum of elements in a dictionary, the elements being vectors representing a known sound event.

The audio processing module may be configured to determine an activated portion of the dictionary, the activated portion being the portion of the dictionary having the greatest number of vectors with non-zero weights, and to cause a signal to be outputted, the signal indicating that the known sound event corresponding to the activated portion of the dictionary has been detected for the audio signal.

The audio processing module may be configured to receive a portion of an input signal and to calculate an energy of the portion of the input signal. The audio processing module may be configured to form, or derive, the matrix. The audio processing module may be configured to divide the portion of the input signal into frames and to calculate the energy of each frame of the portion of the input signal in a particular frequency band and to form the matrix by defining the (i,j)th entry of the matrix as the energy of the jth frame of the portion of the input signal in the ith frequency band. The audio processing module may comprise, or may be configured to communicate with, a filter bank for the purposes of deriving, receiving and/or calculating the energy of a portion of the input signal in a given frequency range. For example, the filter bank may comprise a plurality of filters and the matrix may be formed by defining the (i,j)th entry as the energy of the jth frame in the frequency band defined by the ith filter in the filterbank.

The audio processing module may be configured to communicate with a dictionary storing elements representing known sounds, or known sound events. For example, the audio processing module may be configured to receive at least one vector from a dictionary and/or a matrix from a dictionary (the matrix storing a plurality of vectors), each vector representing a known sound event. The audio processing module may be configured to represent the supervector in terms of the vectors stored in the dictionary, using the dictionary vectors as basis vectors. The audio processing module may be configured to analyse the coefficients of the basis vectors to determine the area of the dictionary to which the majority of non-zero coefficients correspond. The audio processing module may be configured to sum the coefficients, e.g. as described above with reference to the audio processing system. The audio processing module may be configured to compare the coefficient sum to a threshold and to issue a signal based on the comparison. For example, if the coefficients correspond to a region of the dictionary whose vectors represent the same known sound type then the audio processing module may be configured to issue a signal describing that the audio signal is the known sound.

According to one example of this disclosure there is provided a method comprising: receiving, e.g. by a processor, an input signal, the input signal representing an audio signal; determining a measure of the amount of energy in a portion of the input signal; deriving, e.g. by a processor, a matrix representation of the portion of the audio signal, wherein each entry of the matrix comprises the energy in a given frequency band for a given frame of the portion of the input signal; and concatenating, e.g. by a processor, the rows or columns of the matrix to form a supervector, the supervector being a vector representation of the portion of the audio signal.

The method may further comprise determining, by a filterbank comprising a plurality of filters, an energy of at least a portion of the input signal in a given frequency range; wherein each entry of the matrix comprises the energy in a frequency band according to a given filter in the filter bank for a given frame of the input signal.

The method may further comprise processing and/or dividing, e.g. by a processor, the input signal into a plurality of frames. For example, the input signal may be divided into a plurality of frames having a half-frame overlap, so that each frame in the plurality except the first frame and the last frame comprises the second half of the previous frame and the first half of the next frame; wherein each entry of the matrix comprises the energy in a given frequency band for a given frame of the plurality of frames of the input signal.

The method may further comprise processing and/or dividing, e.g. by a processor, the input signal into L frames. For example, the input signal may be divided into L frames having a half-frame overlap, so that each frame in the plurality except the first frame and the last frame comprises the second half of the previous frame and the first half of the next frame; and determining, by a filter bank comprising N filters, each filter in the filter bank being configured to determine an energy of at least a portion of the input signal in a given frequency range; and wherein the matrix is an N×L matrix whose (i,j)th entry comprises the energy of the jth frame in the frequency band defined by the ith filter in the filterbank; and concatenating, e.g. by a processor, the rows of the matrix to form the supervector.

The method may further comprise processing and/or dividing, e.g. by a processor, the input signal into L frames. For example, the input signal may be divided into L frames having a half-frame overlap, so that each frame in the plurality except the first frame and the last frame comprises the second half of the previous frame and the first half of the next frame; and determining, by a filter bank comprising N filters, at least a portion of the input signal in a given frequency range; and wherein the matrix derived by the feature extraction block is an L×N matrix whose (i,j)th entry comprises the energy of the ith frame in the frequency band defined by the jth filter in the filterbank; and concatenating, e.g. by a processor, the columns of the matrix to form the supervector.

The method may further comprise processing and/or dividing, e.g. by a processor, the input signal into a plurality of frames; processing and/or dividing, e.g. by a processor, each frame into a plurality of sub-frames; deriving, e.g. by a processor, a matrix representation of the audio signal for each frame, wherein, for each frame, each entry of the matrix comprises the energy in a given frequency band for a given sub-frame of the input signal; and concatenating, e.g. by a processor, the rows or columns of each matrix to form a supervector, the supervector being a vector representation of the frame of the audio signal.

The method may further comprise processing and/or dividing each frame into K sub-frames. For example, each frame may be divided into K sub-frames having a half-frame overlap, so that each sub-frame in the plurality except the first sub-frame and the last sub-frame comprises the second half of the previous sub-frame and the first half of the next sub-frame; determining, by a filter bank comprising P filters, an energy of at least a portion of the input signal in a given frequency range; and wherein, for each frame, the matrix derived by the feature extraction block is an P×K matrix whose (i,j)th entry comprises the energy of the jth frame in the frequency band defined by the ith filter in the filterbank; and concatenating the rows of the matrix to form the supervector.

The method may further comprise processing and/or dividing each frame into K sub-frames. For example, each frame may be divided into K sub-frames having a half-frame overlap, so that each sub-frame in the plurality except the first sub-frame and the last sub-frame comprises the second half of the previous sub-frame and the first half of the next sub-frame; determining, by a filter bank comprising P filters, an energy of at least a portion of the input signal in a given frequency range; and wherein, for each frame, the matrix derived by the feature extraction block is an K×P matrix whose (i,j)th entry comprises the energy of the ith frame in the frequency band defined by the jth filter in the filterbank; and concatenating the columns of the matrix to form the supervector.

The method may further comprise determining a measure of difference between the or each supervector and an element stored in a dictionary, the element being stored as a vector representing a known sound event. If the measure of difference between a given supervector and a vector in the dictionary representing a known sound event is below a first predetermined threshold, then the method may further comprise outputting a detection signal indicating that the known sound event has been detected for the portion of the input signal corresponding to the given supervector. If a given number of supervectors for which the measure of difference is below the first predetermined threshold is above a second predetermined threshold, then the method may further comprise outputting a detection signal indicating that the known sound event has been detected for the portion of the input signal corresponding to the given number of supervectors.

The method may further comprise representing the or each supervector in terms of a weighted sum of elements of a dictionary, each element of the dictionary being stored as a vector representing a known sound event, the dictionary storing the elements as a matrix of vectors, the classification unit thereby being configured to represent the or each supervector as a product of a weight vector and the matrix of vectors.

Vector entries in the dictionary matrix may be grouped according to the type of known sound, and the method may further comprise, for the or each supervector, determining an activated known sound type being the known sound type having the greatest number of vectors having non-zero coefficients when the or each supervector is represented as the weighted sum; summing the coefficients of the vectors in the activated known sound type; and comparing the sum to a third predetermined threshold. If the sum is greater than the third predetermined threshold then the method may further comprise outputting a detection signal indicating that the activated known sound type has been detected for the or each supervector.

The method may further comprise, for the or each supervector, summing the coefficients of the vectors in each group according to each type of known sound to determine an activated known sound type being the known sound type whose vector coefficients have the highest sum; summing the coefficients in the activated known sound type to a fourth predetermined threshold. If the sum is greater than the fourth predetermined threshold then the method may further comprise outputting a detection signal indicating that the activated known sound type has been detected for the or each supervector.

The method may further comprise averaging the sum of the coefficients of the vectors in the activated known sound type, for each supervector; and comparing the average to a fifth predetermined threshold. If the average sum is greater than the fifth predetermined threshold then the method may comprise outputting a detection signal indicating that the activated known sound type has been detected for the audio signal.

In the examples above the input signal (representing the audio signal) may comprise a representation in terms of wavelets and/or a spectrogram. In another example, the "pure signal" may be used. For example, the signal in the time domain may be divided into frames and the energy for each frame may be computed in a given frequency range by the filterbank, etc.

Examples of the present aspects seek to facilitate audio event detection based on a dictionary. The dictionary may be compiled by spectral features and may be made of at least one target event and a universal range comprising a various number of other audio events. The distinction between target and non-target may be determined by the values of a set of weights obtained by non-negative matrix factorisation (NMF) NMF aims to reconstruct the observed signal as a linear or mel-based combination of elements of a dictionary. By looking at the weights, it is possible to determine to which part of the dictionary the observation is the closest, hence determine if the event is the targeted one or not.

The present examples may be used to facilitate user-training of a dictionary. Thus, a target audio event may be defined and input by a user for professing. For example, the user may present—as an audio signal/recording—multiple instances of the target event. A time-frequency representation, e.g. a supervector may be derived for each instance and these representations may be used to compile a dictionary. In real time, an observed audio signal, or information/characteristics/features derived therefrom, may be compared to the dictionary using the Active-Set Newton Algorithm (ASNA) to obtain a set of weights that will enable detection of the audio event to be concluded.

According to another aspect of the present invention, there is provided a computer program product, comprising a computer-readable tangible medium, and instructions for performing a method according to the present examples or for implementing a system according to any of the present examples.

According to another aspect of the present invention, there is provided a non-transitory computer readable storage medium having computer-executable instructions stored thereon that, when executed by processor circuitry, cause the processor circuitry to perform a method according to the present examples or for implementing a system according to any of the present examples.

Features of one example or aspect may be combined with the features of any other example or aspect.

For a better understanding of the present invention, and to show how the same may be carried into effect, reference will now be made by way of example to the accompanying drawings in which:

FIGS. 6A and 6B illustrate a matrix feature representing the amount of energy in a given frequency band;

FIG. 9 is a block diagram of an Audio Event Detection system according to a present example;

FIG. 10A shows a plot of the variation of the frequency bin energies of an observed signal x;

FIG. 10B shows the dictionary atoms B; and

FIG. 10C shows the weights activated by the NMF algorithm.

DETAILED DESCRIPTION OF THE PRESENT EXAMPLES

The description below sets forth examples according to this disclosure. Further example embodiments and implementations will be apparent to those having ordinary skill in the art. Further, those having ordinary skill in the art will recognize that various equivalent techniques may be applied in lieu of, or in conjunction with, the embodiments discussed below, and all such equivalents should be deemed as being encompassed by the present disclosure.

The methods described herein can be implemented in a wide range of devices such as any mobile telephone, an audio player, a video player, a mobile computing platform, a games device, a remote controller device, a toy, a machine, or a home automation controller or a domestic appliance. However, for ease of explanation of one embodiment, an illustrative example will be described, in which the implementation occurs in a wireless communication device, such as a smartphone.

Figure 1:
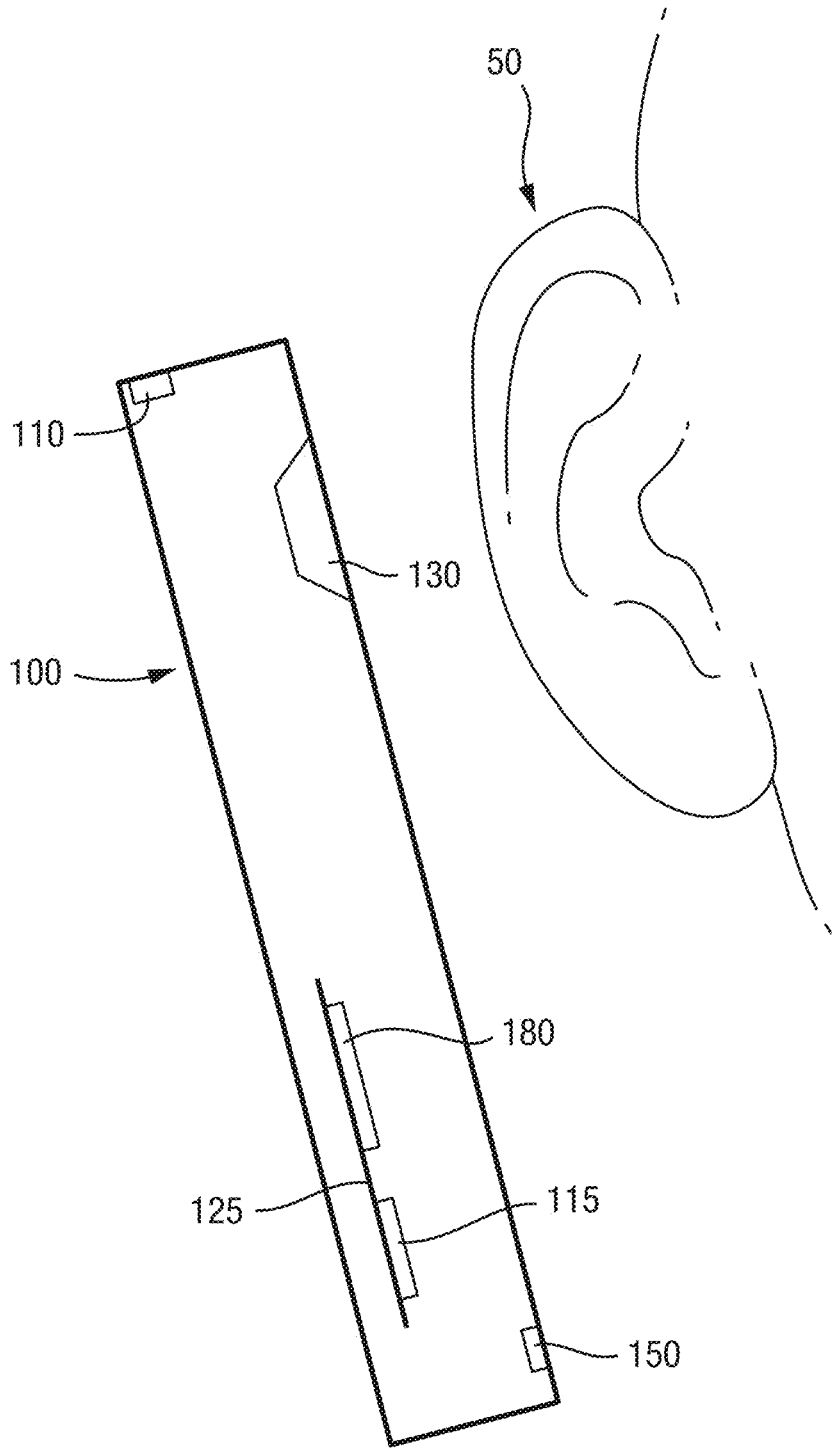
FIG. 1 illustrates a wireless communication device 100.

FIG. 1 illustrates a wireless communication device 100. The wireless communication device comprises a transducer, such as a speaker 130, which is configured to reproduce distance sounds, such as speech, received by the wireless communication device along with other local audio events such as ringtones, stored audio program material, and other audio effects including a noise control signal. A reference microphone 110 is provided for sensing ambient acoustic events. The wireless communication device further comprises a near-speech microphone which is provided in proximity to a user's mouth to sense sounds, such as speech, generated by the user.

A circuit 125 within the wireless communication device comprises an audio CODEC integrated circuit (IC) 180 that receives the signals from the reference microphone, the near-speech microphone 150 and interfaces with the speaker and other integrated circuits such as a radio frequency (RF) integrated circuit 12 having a wireless telephone transceiver.

Figure 2:
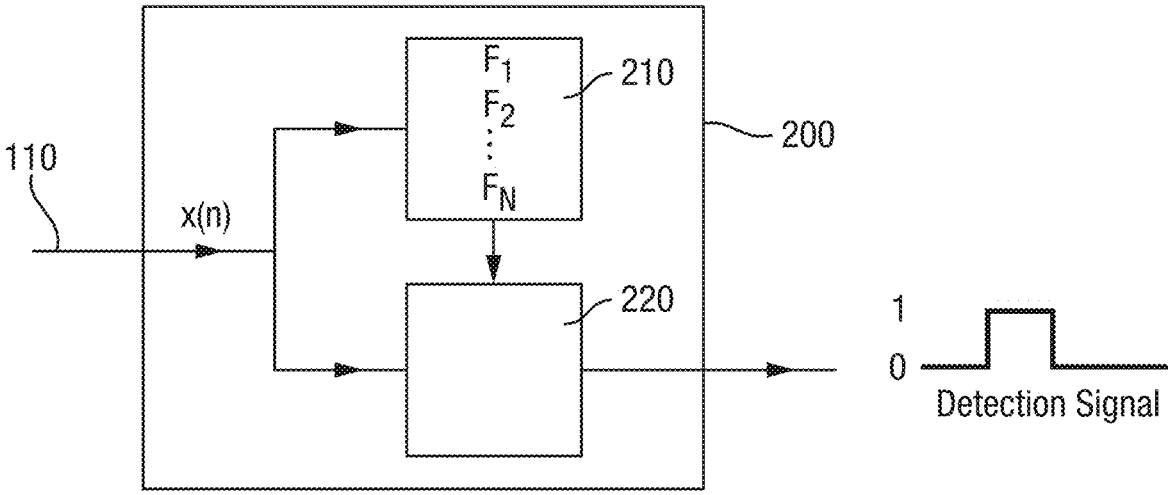
FIG. 2 is a block diagram showing selected units or blocks of an audio signal processing system according to a first example.

FIG. 2 is a block diagram showing selected units or blocks of an audio signal processing system according to a first example. The audio processing system may, for example, be implemented in the audio integrated circuit 180 provided in the wireless communication device depicted in FIG. 1. Thus, the integrated circuit receives a signal based on an input signal received from e.g. reference microphone 110. The input signal may be subject to one or more processing blocks before being passed to the audio signal processing block 200. For example the input signal may be input to an analog-to-digital converter (not shown) for generating a digital representation of the input signal x(n). According to this example the audio signal processing unit 200 is configured to detect and classify an audio event that has been sensed by the microphone 110 and that is represented in the input signal x(n). Thus, the audio signal processing unit 200 may be considered to be an audio event detection unit.

The audio event detection unit 200 comprises, or is associated with, a dictionary 210. The dictionary 210 comprises memory and stores at least one dictionary element or feature F. A dictionary feature F may be considered to be a predetermined representation of one or more sound events. One or more of the dictionary feature(s) may have been derived from recording/sensing one or more instances of a specific target sound event during a dictionary derivation method that has taken place previously. According to one or more examples a dictionary derivation method takes place in conjunction with a feature extraction unit as illustrated in FIG. 3.

Additionally or alternatively, the audio event detection unit 200 is provided in conjunction with a feature extraction unit 300 configured to derive one or more features or elements to be stored in a dictionary associated with the audio signal processing unit 140. Thus, it will be appreciated that a user defined target sound event may be input by a user in order to derive a dictionary feature that will be stored in memory and to allow subsequent detection of an instance of the target sound event.

The audio signal processing unit 200 may comprise or be associated with a comparator or classification unit 220. The comparator is operable to compare a representation of a portion of an input signal with one or more dictionary elements. If a positive comparison is made indicating that a particular sound event has been detected, the comparator 220 is operable to output a detection signal. The detection signal may be passed to another application of the device for subsequent processing. According to one or more examples the detection signal may form a trigger signal which initiates an action arising within the device or an applications processor of the device.

Figure 3:
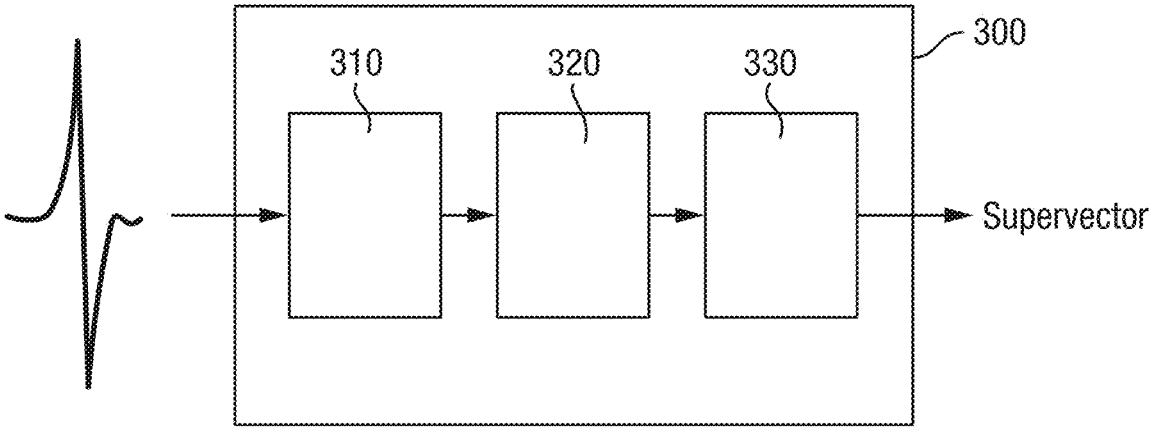
FIG. 3 illustrates a processing module 300 according to a second example.

FIG. 3 shows a processing module 300 according to a second example. The processing module is configured to derive one or more features, each feature comprising a representation of a sound event. The processing module 300 may be considered to be a feature derivation unit configured to receive an input signal based on a signal derived from sensed audio. It will be appreciated that the feature derivation unit 300 may be utilised as part of a training process for training or deriving a dictionary 210. Thus, in this case, the sensed audio may comprise one or more instances of a target/specific audio event such as a handclap, a finger click or a sneeze. The target audio events may be selected during a training phase to have different characteristics in order to train the system to detect and or classify different kinds of audio signals. The target audio events may be user-selected in order to complement an existing dictionary of an audio event detection system implemented, for example, in a user device. Additionally or alternatively the feature derivation unit 300 may be utilised as part of a real-time detection and/or classification processes in which case the sensed audio may comprise ambient noise (which may include one or more target audio events to be detected). It will also be appreciated that the input signal may be derived from recorded audio data or may be derived in real time.

In this example the feature derivation unit 300 comprises at least a feature extraction block 330. In this example the feature derivation unit 300 additionally comprises an energy detection block 310 and a frequency visualisation block 320. However, it will be appreciated that these blocks are optional. For example, the feature derivation unit may comprise only the feature extraction block 330. It will also be appreciated that an energy detection block and/or a frequency visualisation block may be provided separately to the feature derivation unit 300 and configured to receive a signal based on the input signal at a processing stage in advance of the feature derivation unit.

Figures 4, 5:
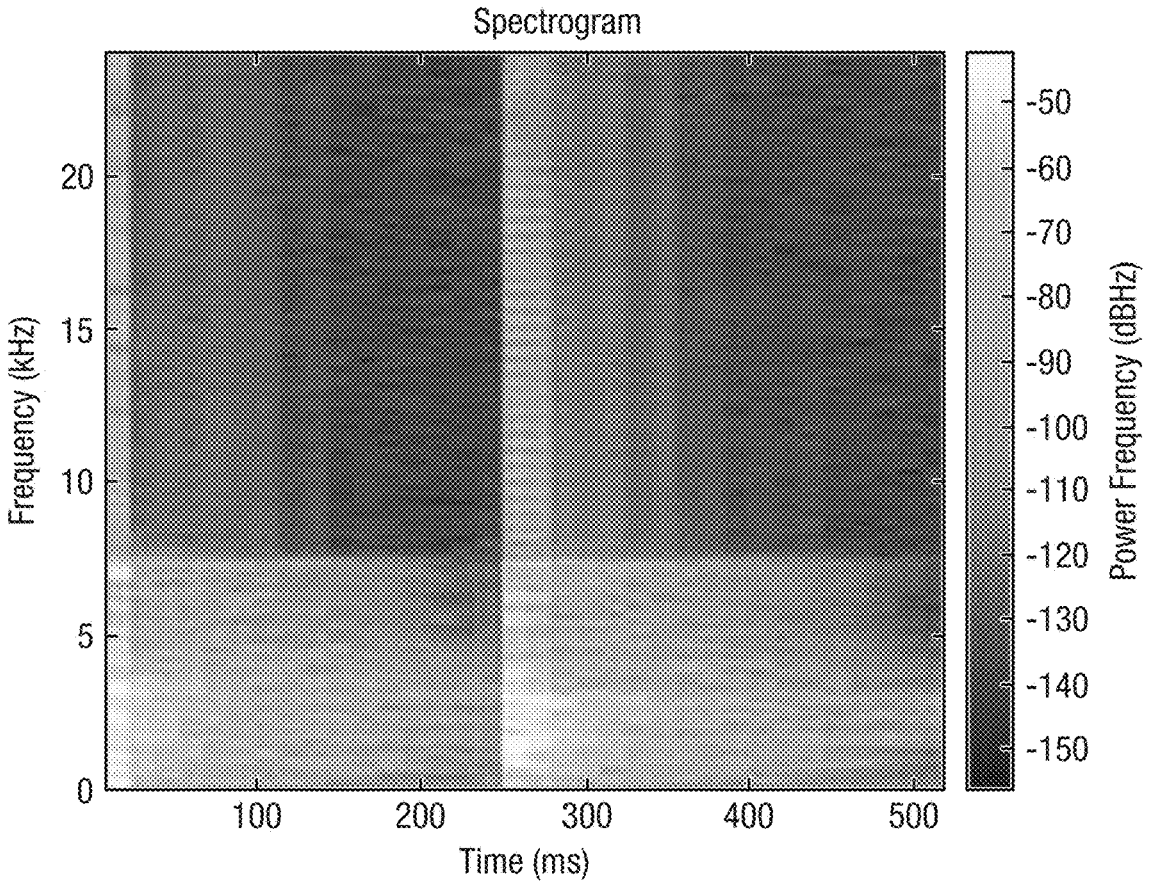
FIG. 4 illustrates the processing of an audio signal into frames.
FIG. 5 illustrates an example of a spectrogram obtained by a frequency visualisation block.

The energy detection block 310 is configured to carry out an energy detection process. According to one example, a signal based on the input signal is processed into frames. According to one example a half frame overlap is put in place to better allow the acquisition and processing can happen in real time. Therefore, each frame will be constituted of the second half of the previous frame and of half a frame of new incoming data. This is shown in FIG. 4. According to another example, a signal based on the input signal is processed into frames, with each frame then being processing into sub-frames. Each sub-frame in a given frame may have a half frame overlap. In other words, each sub-frame may be constituted of the second half of the previous frame and of half a new frame of incoming data. This may be done for each frame constituting the input signal.

Energy detection is then performed on the new frame (or new sub-frame in examples where the signal is divided into frames, and each frame is divided into sub-frames). Energy detection is beneficial to ensure that subsequent processing of the input signal by the components of an AED system does not take place if the detected input signal comprises only noise. The energy is tested, e.g. by looking at the RMS value of the samples in the frame: if they exceed the threshold, energy is detected. Each time energy is detected, a counter is set to 10. The counter is decreased at each non-detection. This ensured that a certain number of frames, e.g. ten, are processed.

The frequency visualisation block 320 is configured to allow the frequency content of the signal to be visualised at a particular moment in time. Thus, according to one example the frequency visualisation 320 may be configured to derive a spectrogram. The spectrogram may be obtained through analog or digital processing. According to a preferred example the spectrogram is obtained by digital processing. Specifically, a Short-Time Fourier Transform is applied to the waveform which is divided into frames or sub-frames. The STFTs of the frames, or sub-frames, are thus obtained and are concatenated. The STFT has been proven to be a very powerful tool in tasks that aim to recreate human auditory perception, like auditory scene recognition. According to one specific example a spectrogram is obtained through a digital process, using the MATLAB command spectrogram:

spectrogram(w, 1440, 720, [ ], 48e3, 'yaxis')

where w is the time-domain waveform, 1440 is the number of samples in a frame, 720 is the number of overlapping samples, 48e3 is the sampling frequency and y-axis determines the position of the frequency axis. With this command, MATLAB performs the SIFT on frames of the size specified, taking into account the desired overlap, and plots the spectrogram with respect to the relative frequency. An example of a spectrogram obtained by the frequency visualisation block 320 from the recording of two handclaps is shown in FIG. 5.

The feature extraction block 330 is configured to derive or extract one or more features from the time frequency visualisation (e.g. the spectrogram) derived by the frequency visualisation block 320. In other examples (e.g. where the feature derivation unit 300 does not comprise the frequency visualisation block 320), the feature extraction block 330 is configured to derive or extract one or more feature from the input signal, with the input signal being a pure signal in the time domain or represented in terms of wavelets. In some examples, the input signal and/or a frame of the input signal and/or a sub-frame of a frame of the input.

In some examples therefore an input signal is divided into frames, e.g. as described above, and a Fourier transform (as described above) is performed for each frame constituting the input signal. In some examples, an input signal is divided into frames and each frame is divided into sub-frames, and a Fourier transform (as described above) is performed for each sub-frame constituting each frame of the input-signal.

In either example, it will be appreciated that a number of feature categories may be selected. Preferably, however, the features chosen should be computationally easy to extract since this will make real-time processing more effective. For example, according to one or more example, the feature extraction block is configured to derive a feature comprising a measure of the amount of energy in a given frequency band. Thus, the extracted features may be derived by implementing a series or bank of frequency filters, wherein each filter is configured to sum or integrate the energy in a particular frequency band. This may be done for each frame (in examples where the input is divided into frames), or each sub-frame (in examples where the frames are divided into sub-frames). According to at least one example the filters may be spaced linearly and the feature extraction block is configured to derive linear filter bank energies (LFBEs). Alternatively, the filters or may be spaced according to the mel frequency representation which mimics human auditory perception and the feature extraction block can be considered to be configured to derive Mel-based filter bank energies. The amplitude is evaluated at frequency points spaced on the mel scale according to:

$$f_{mel} = 2595 + \log_{10}\left(1 + \frac{f_{HZ}}{700}\right) \quad \text{Equation (1)}$$

where $f_{mel}$ is the frequency in mel scale and $f_{Hz}$ is the frequency in Hz.

The triangular filter bank makes it possible to integrate the energy in a frequency band. Using the filters in conjunction with the mel scale, it is possible to provide a bank of filters that are spaced according to approximately linear spacing at low frequencies, while having a logarithmic spacing at higher frequencies. This makes the feature extraction block particularly suitable for capturing features that represent the phonetic characteristics of speech. Advantageously, this representation provides a good level of information about the spectrum in a compact way, making the processing more computationally efficient.

The feature extraction block may be implemented by executing a program on a computer. From a software point of view, the feature extraction block may be configured to sum the magnitude of the spectral components across each band:

```
for i = 1: samplesPerBand : obj.samplesPerFrame / 2
  obj.fBuffer(1 +(i−1) / (samplesPerBand),:) =
sum(abs(Xfft(i:i + samplesPerBand −1,:)));
end
```

Figure 6B:
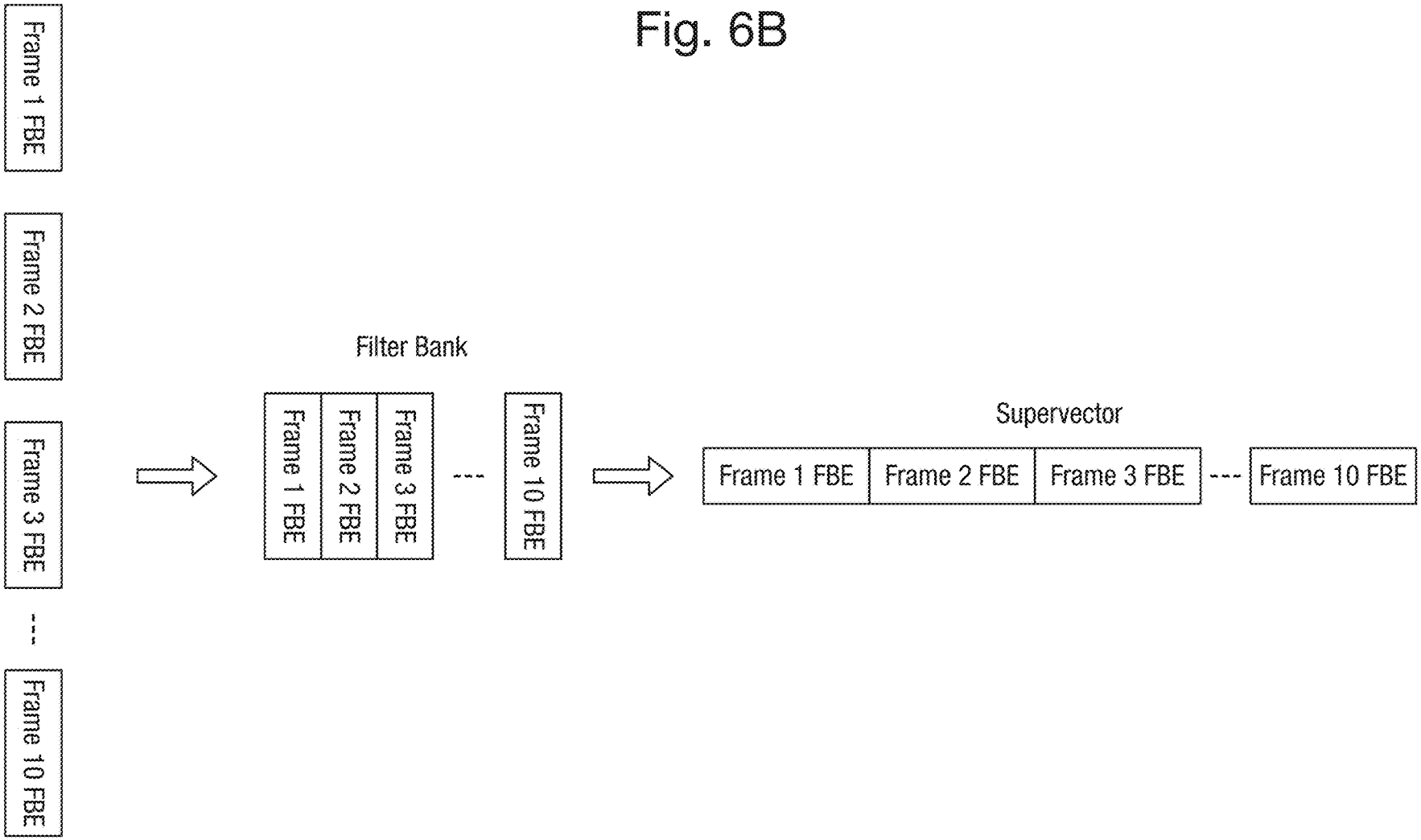

A Fast Fourier transform (FFT) of the time-domain signal may be obtained using MATLAB's command fft(x). According to a specific example the signal being processed comprises ten frames stored in a buffer. The signal represents an audio recording which may comprise an instance of a target event recorded for the purposes of training an AED system. According to one example the summation is implemented frame by frame. The resulting matrix is an N×10 matrix as shown in FIG. 6A, where N is the number of filters that are being implemented (e.g. 40). According to at least one example, the resulting filter bank energies (FBEs) for all frames are then concatenated to obtain a supervector. Thus, the summation of the filter bank energies are represented a frame at a time (i.e. the frame 2 follows directly from frame 1, frame 3 follows directly from frame 3 and so on). The process of concatenation is illustrated in FIG. 6B.

Therefore, in one example an input signal is divided into 10 frames and a FFT of each frame is performed (e.g. using the MATLAB command as described above). A filterbank may be implemented comprising 40 filters, and the energies for each frame of the input signal are therefore obtained across each frequency range. FIG. 6A shows the 40×10 matrix that is derived where the rows of the matrix represent each filter in the filter bank and the columns of the matrix represent each frame of the input signal. The (i,j)th entry of this matrix is therefore the energy of the input signal in the frequency domain in the frequency band defined by the ith filter for the jth frame.

In another example, an input signal may be divided into frames and each frame may be divided into 10 sub-frames. A FFT may be performed and a filter bank comprises 40 filters may be employed. In this case, FIG. 6A may show the 40×10 matrix derived for each frame, with the columns of the matrix representing each sub-frame of the input signal. The (i,j)th entry of this matrix is therefore the energy of the input signal in the frequency domain in the frequency band defined by the ith filter for the jth sub-frame.

FIG. 6B shows how the columns of the matrix of FIG. 6A are concatenated to form the supervector. However, the matrix (e.g. the matrix of FIG. 6A) may be derived differently, for example the columns of the matrix may represent each filter in the filter bank and the rows of the matrix may represent each frame (the matrix of FIG. 6A in this example thereby being a 10×40 matrix, the transpose of the matrix of FIG. 6A). In these examples the supervector (FIG. 6B) may be formed (or derived) by concatenating the rows of the matrix (rather than the columns as is shown in FIG. 6B).

It will therefore be appreciated that, in examples where a portion of the input signal is divided into frames, the supervector will correspond to the input signal. In examples where an input signal is divided into frames and each frame is divided into sub-frames, the supervector will correspond to the frame of the input signal, and therefore in this example a plurality of supervectors will be derived for the input signal, one supervector per frame of the input signal.

According to one example wherein the feature extraction unit is operable as part of a method of deriving or training a dictionary, a supervector can advantageously form, or be used to derive, a dictionary element or feature of a dictionary according to the present examples.

Figure 7:
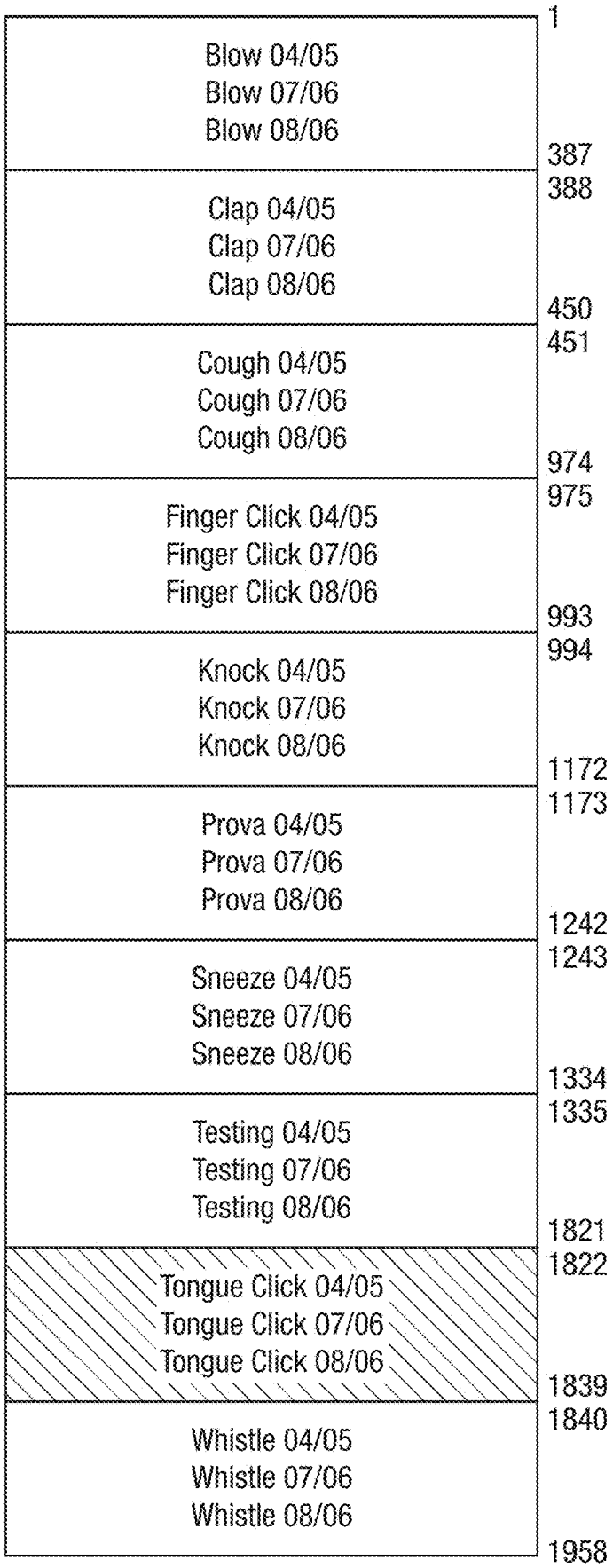
FIG. 7 shows such a dictionary comprising a plurality of supervectors.
Figure 8:
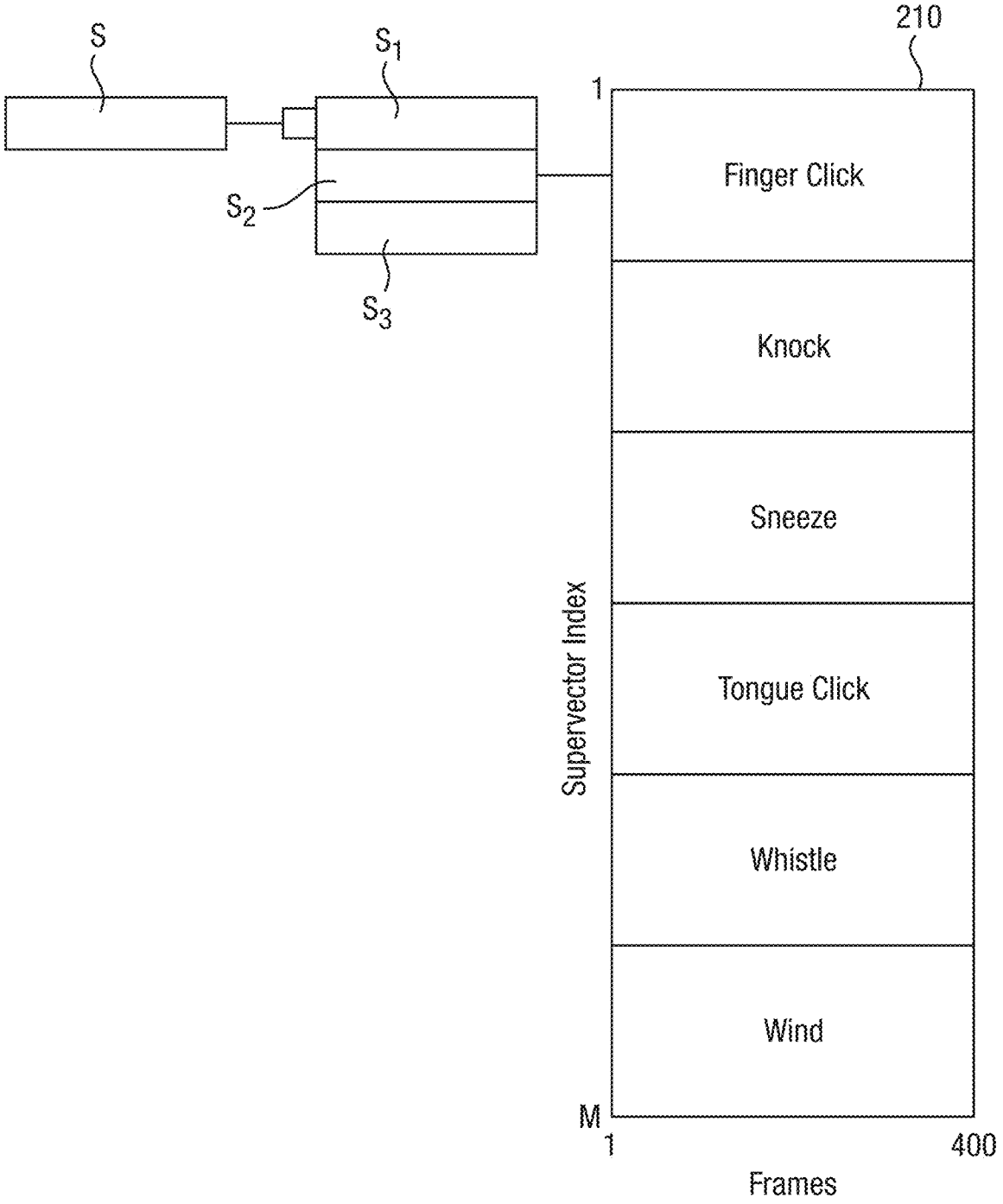
FIG. 8 shows the correspondence between a supervector, multiple supervectors and a concatenation of supervectors forming a dictionary.

FIG. 7 shows such a dictionary comprising a plurality of features (or elements), each feature comprising a supervector. The features (supervectors) are concatenated vertically. The number of supervectors per class depends on the length of the recordings used for training. The features of the three recordings of each class are concatenated, in order to make the target identification easier. Each class has an associated range of the supervector indices. The correspondence between a single supervector S obtained for an instance of a particular class of target event, the matrix compiled from 3 examples of the same class of target event and the resultant dictionary is shown in FIG. 8. The dictionary can be considered to comprise an index 1 M of supervectors representing a variety of different target sounds. One or more of the dictionary features may be derived by a user. It is envisaged that some dictionary features will be pre-calculated.

In the example of FIG. 7, the dictionary comprises a 1958×1 matrix whose entries are vectors and which are arranged in groups of known sounds types. For example, according to FIG. 7, the first 387 rows of the matrix comprise vectors representing known blows, rows 388-450 of the matrix comprise vectors representing known claps, etc. It will be appreciated that although the matrix of FIG. 7 is a 1958×1 matrix whose entries are vectors, this is a 1958×m matrix whose entries are numbers (m being the dimension, or length, of each vector in the matrix—e.g. the vectors blow 04/05, blow 07/06 etc.).

According to a further example, wherein the feature extraction unit 300 is operable as part of an audio event detection system, a output supervector may be input to a comparator or classification unit 220 to allow the supervector, which may be considered to be a representation of at least a portion of an observed input signal, to be compared with one or more dictionary elements.

FIG. 9 illustrates a schematic of an overall Audio Event Detection system comprising a feature extraction unit 300 and an audio event detection unit 200. The input to the feature extraction unit 300 may comprise training data or test data. In the case where the input signal represents training data, the feature extracted by the feature extraction block 330 of the feature extraction unit will form an element or feature of a dictionary 210. In the case where the input signal represents test data, the feature extracted by the feature extraction unit will be input to a classification unit 220, to allow one or more target audio events present in the test audio data signal to be detected and classified.

According to one example of an audio event detection unit comprising a comparator or classification unit 220, the comparator is configured to determine a proximity metric which represents the proximity of an observed, test, signal to one or more pre-compiled dictionary elements or features. The observed test signal is processed in order to extract features which allow comparison with the pre-compiled dictionary elements. Thus, the observed test signal preferably undergoes processing by a feature extraction unit such as described with reference to FIG. 3.

According to at least one example, the classification unit 220 is configured to perform a method of non-negative matrix factorisation (NMF) in order to recognise, in real time, an audio event. Generally speaking, the classification unit is configured to compare spectral features extracted from a test signal with pre-compiled spectral features which represent one or more target audio events.

According to one example, the distinction between a target audio event and a non-target audio event is determined by the values of a set of weights obtained by a method based on NMF. NMF aims to approximate a signal as the weighted sum of elements of a dictionary, called atoms:

$$x \approx \hat{x} = \sum_n w_n b_n = wB \qquad \text{Equation (2)}$$

where x is the observed signal, $\hat{x}$ is its approximation, $b_n$ is the dictionary atom of index n and $w_n$ is the corresponding weight. w is the vector of all weights, while B is the dictionary, made of N atoms. FIG. 10A shows a plot of the variation of the frequency bin energies of an observed signal x. FIG. 10B shows the dictionary atoms B whilst FIG. 10C shows the weights activated by the NMF algorithm. As mentioned before, the weights are associated to a specific supervector (indices shown from 1 to M).

In equation (2), the supervector is represented as a (dot) product or matrix product of a weight vector w and the matrix B. The matrix B is the dictionary (for example shown in FIG. 7 and may comprise a matrix of vectors arranged into groups as described above). With reference to FIG. 7, the basis for the dictionary B is therefore 1958-dimensional, with 1958 basis vectors (each basis vector being a vector in the dictionary B of FIG. 7). Equation (2) expresses the supervector representation of the input signal in terms of these basis vectors.

By looking at the weights, it is possible to determine to which part of the dictionary the observation is the closest, hence determine if the event is the targeted one or not.

The dictionary and weights may be obtained such that the divergence between the observation and its approximation is minimised. It will be appreciated that a number of different stochastic divergences can be used. For example, the Kullback-Leibler divergence:

$$KL(x\|\hat{x}) = \sum_i \begin{cases} x_i \log\left(\frac{x_i}{\hat{x}_i}\right) - x_i + \hat{x}_i, & \text{if } x_i, \hat{x}_i > 0 \\ \hat{x}_i, & \text{if } x_i = 0 \\ \infty, & \text{if } x_i > 0, \hat{x}_i = 0 \end{cases}$$

Where x is the observation, $\hat{x}$ is the estimation and i is the frequency bin index.

One or more examples may utilise an algorithm known as the Active-set algorithm (ASNA) which is a variation of standard NMF methods. The main difference between ASNA and other NMF techniques is that ASNA is a one-step NMF method: while in the general case of NMF the dictionary is unknown and obtained based on the observations, in ASNA the dictionary is already known and precompiled, and the updates are made only on the activation matrix, that is expressed as a vector of weights associated to the dictionary atoms. Moreover, instead of updating all of the weights, ASNA updates just a small set of them (the so-called active set), that would provide the best approximation in a significantly smaller number of iterations.

Thus, according to one example wherein spectral features (e.g. supervector) derived from a signal based on an observed signal is input to the classification unit 220 and an observation step is carried out in order to compare the spectral features to one or more spectral features stored in the dictionary 210.

According to one or more examples the final decision to determine the detection of the target event is based on the weights generated from the NMF algorithm.

At a supervector level, the weights activated in the target range of the dictionary are summed up and compared to a threshold: if the threshold is exceeded, the event is said to be detected for that specific supervector.

$$\sum_{i=SV_{begin}}^{SV_{end}} W_i > \varepsilon_{supervector} \quad \text{Equation (3)}$$

Where $SV_{begin}$ is the first supervector of the target range, $SV_{end}$ is the last one and $\varepsilon_{supervector}$ is the threshold for the supervector detection.

At event level, the sums of the activations in the target region are averaged across the number of supervectors that constitute the event and compared to another threshold. If this threshold is exceeded as well, the overall event is said to be detected.

$$\sum_{n=1}^{N} \sum_{i=SV_{begin}}^{SV_{end}} W_i > \varepsilon_{event} \quad \text{Equation (4)}$$

Where N is the total number of supervectors, $SV_{begin}$ is the first supervector of the target range, $SV_{end}$ is the last one and $\varepsilon_{event}$ is the threshold for the event detection.

When a supervector is represented in terms of the dictionary elements (e.g. equation (2)) the entries of the weight vector $w_i$ are coefficients of the (basis) dictionary elements, $b_i$. The target range of the dictionary is the part of the dictionary containing the vectors whose coefficients $w_i$ are non-zero when the supervector is written in terms of the dictionary elements. With reference to FIG. 7, if the majority of non-zero coefficients in a supervector expansion (according to equation (2)) correspond to vectors in the "finger click" range (e.g. the vectors in rows 975-993) then this region is said to be activated. The weights $w_i$ in this target range (e.g. the coefficients of the vectors in the "finger click" range) are summed up according to equation (3) to determine whether the audio signal is the type known sound (the sound in the target range of the dictionary, e.g. the "finger click"). If the threshold of equation (3) is exceeded, the event (e.g. the finger click) is said to be detected for that specific supervector. In one example, the threshold may be 0.5.

Equation (4) represents the average of the sums of weights of each supervector whose weight sum in the activated region exceeded the threshold defined by equation (3). In other words, for each supervector whose weights in the target, or "activated", region of the dictionary exceed the threshold, e.g. meet the requirement of equation (3), these weight sums are averaged to determine if, on average, the a set of supervectors (constituting a sound event) exceed a threshold. If this threshold is exceeded the event is said to be detected for the event. Equation (4) therefore minimises the instance of a false positive in the event that one supervector in a set of 10 supervectors constituting a sound event has an activated weight average exceeding the threshold but the other supervectors do not.

The skilled person will recognise that some aspects of the above-described apparatus and methods may be embodied as processor control code, for example on a non-volatile carrier medium such as a disk, CD- or DVD-ROM, programmed memory such as read only memory (Firmware), or on a data carrier such as an optical or electrical signal carrier. For many applications embodiments of the invention will be implemented on a DSP (Digital Signal Processor), ASIC (Application Specific Integrated Circuit) or FPGA (Field Programmable Gate Array). Thus the code may comprise conventional program code or microcode or, for example code for setting up or controlling an ASIC or FPGA. The code may also comprise code for dynamically configuring re-configurable apparatus such as re-programmable logic gate arrays. Similarly the code may comprise code for a hardware description language such as Verilog™ or VHDL (Very high speed integrated circuit Hardware Description Language). As the skilled person will appreciate, the code may be distributed between a plurality of coupled components in communication with one another. Where appropriate, the embodiments may also be implemented using code running on a field-(re)programmable analogue array or similar device in order to configure analogue hardware.

Note that as used herein the term module, unit or block shall be used to refer to a functional component which may be implemented at least partly by dedicated hardware components such as custom defined circuitry and/or at least partly be implemented by one or more software processors or appropriate code running on a suitable general purpose processor or the like. A module/unit/block may itself comprise other modules/units/blocks. A module/unit/block may be provided by multiple components or sub-modules which need not be co-located and could be provided on different integrated circuits and/or running on different processors.

Embodiments may be implemented in a host device, especially a portable and/or battery powered host device such as a mobile computing device for example a laptop or tablet computer, a games console, a remote control device, a home automation controller or a domestic appliance including a domestic temperature or lighting control system, a toy, a machine such as a robot, an audio player, a video player, or a mobile telephone for example a smartphone.

Examples of the invention may be provide according to any one of the following numbered statements:

1. An audio processing system for an audio event detection (AED) system, comprising:

an input for receiving an input signal, the input signal representing an audio signal;

a feature extraction block configured to derive at least one feature which represents a spectral feature of the input signal.

2. An audio processing system as recited in any preceding statement, wherein the feature extraction block is configured to derive the at least one feature by determining a measure of the amount of energy in a given frequency band of the input signal.

3. An audio processing system as recited in statement 2, wherein the feature extraction block comprises a filter bank comprising a plurality of filters.

4. An audio processing system as recited in statement 4, wherein the plurality of filters are spaced according to a mel-frequency scale.

5. An audio processing system as recited in statement 3 or 4, wherein the feature extraction block generates, for each frame of the audio signal, a feature matrix representing the amount of energy in each of the filters of the filter bank.

6. An audio processing system, wherein the feature extraction block is configured to concatenate each of the feature matrices in order to generate a supervector corresponding to the input signal.

7. An audio processing system as recited in any preceding statement, further comprising:

a classification unit configured to compare the at least one feature derived by the feature extraction unit with one or more stored elements of a dictionary, each stored element representing one or more previously derived features of an audio signal derived from a target audio event.

8. An audio processing system as recited in statement 7, wherein the classification unit is configured to determine a proximity metric which represents the proximity of the at least one feature derived by the feature extraction unit to one or more of the previously derived features stored in the dictionary.

9. An audio processing system as recited in any one of statements 7 or 8 wherein the classification unit is configured to perform a method of non-negative matrix factorisation (NMF) wherein the input signal is represented by a weighted sum of dictionary features (or atoms).

10. An audio processing system as recited in statement 9, wherein the classification unit is configured to derive or update one or more active weights, the active weight(s) being a subset of the weights, based on a determination of a divergence between a representation of the input signal and a representation of a target audio event stored in the dictionary.

11. An audio processing system as recited in statement 6 wherein the audio processing system further comprising a classification unit configured to determine a measure of a difference between the supervector and a previously derived supervector corresponding to a target audio event.

12. An audio processing system as recited in statement 11, wherein if the measure of the difference is below a predetermined threshold, the classification unit outputs a detection signal indicating that the target audio event has been detected.

13. An audio processing system as recited in statement 12, wherein the detection signal comprises a trigger signal for triggering an action by an applications processor of the device.

14. An audio processing system as recited in statement 6 wherein the supervector is output to a dictionary and stored in memory associated with the dictionary.

15. An audio processing system as recited in any preceding statement, further comprising a frequency representation block for deriving a representation of the frequency components of the input signal, the frequency representation block being provided at a processing stage ahead of the feature extraction block.

16. An audio processing system as recited in statement 15, wherein the frequency representation comprises a spectrogram.

17. An audio processing system as recited in any preceding statement, further comprising an energy detection block, the energy detection block being configured to receive the input signal and to carry out an energy detection process, wherein if a predetermined energy level threshold is exceeded, the energy detection block outputs the input signal, or a signal based on the input signal, in a processing direction towards the feature extraction unit.

18. A method of training a dictionary comprising a representation of a one or more target audio events, comprising:

each frame of a signal representing an audio signal comprising a target audio event, extracting one or more spectral features, compiling a representation of the spectral features derived for a series of frames and storing the representation in memory associated with a dictionary.

19. A method of training a dictionary as recited in statement 18, wherein the representation comprises a supervector.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in a claim, "a" or "an" does not exclude a plurality, and a single feature or other unit may fulfil the functions of several units recited in the claims. Any reference numerals or labels in the claims shall not be construed so as to limit their scope.

The invention claimed is:

1. An audio processing system comprising:

an input for receiving an input signal, the input signal representing an audio signal; and a feature extraction block configured to determine a measure of the amount of energy in a portion of the input signal, and to derive a matrix representation of the portion of the audio signal, wherein each entry of the matrix comprises the energy in a given frequency band for a given frame of the portion of the input signal, and to concatenate the rows or columns of the matrix to form a supervector, the supervector being a vector representation of the portion of the audio signal, wherein the audio processing system is configured to classify the input signal as a known sound event based on a comparison between the supervector and a stored representation of a known sound event.

2. An audio processing system as claim 1, wherein the feature extraction block further comprises:

a filter bank comprising a plurality of filters, each filter in the filter bank being configured to determine an energy of at least a portion of the input signal in a given frequency range; and wherein each entry of the matrix comprises the energy in a frequency band according to a given filter in the filter bank for a given frame of the input signal.

3. An audio processing system as claimed in claim 1, further comprising:

an energy detection block configured to process the input signal into a plurality of frames; and wherein each entry of the matrix comprises the energy in a given frequency band for a given frame of the plurality of frames of the input signal.

4. An audio processing system as claimed in claim 1, further comprising:

an energy detection block configured to process the input signal into L frames; and wherein the feature extraction block further comprises:

a filter bank comprising N filters, each filter in the filter bank being configured to determine an energy of at least a portion of the input signal in a given frequency range; and wherein the matrix derived by the feature extraction block is an N×L matrix whose (i,j)th entry comprises the energy of the jth frame in the frequency band defined by the ith filter in the filterbank, and wherein the feature extraction block is configured to concatenate the rows of the matrix to form the supervector.

5. An audio processing system as claimed in claim 1, further comprising:

an energy detection block configured to process the input signal into L frames; and wherein the feature extraction block further comprises:

a filter bank comprising N filters, each filter in the filter bank being configured to determine an energy of at least a portion of the input signal in a given frequency range; and wherein the matrix derived by the feature extraction block is an L×N matrix whose (i,j)th entry comprises the energy of the ith frame in the frequency band defined by the jth filter in the filterbank, and wherein the feature extraction block is configured to concatenate the columns of the matrix to form the supervector.

6. An audio processing system as claimed in claim 1, further comprising:

an energy detection block configured to process the input signal into a plurality of frames, and to process each frame into a plurality of sub-frames; and wherein, the feature extraction block is configured to derive a matrix representation of the audio signal for each frame, wherein, for each frame, each entry of the matrix comprises the energy in a given frequency band for a given sub-frame of the input signal, and to concatenate the rows or columns of each matrix to form a supervector, the supervector being a vector representation of the frame of the audio signal.

7. An audio processing system as claimed in claim 6, further comprising:

an energy detection block configured to process each frame into K sub-frames; and wherein the feature extraction block further comprises:

a filter bank comprising P filters, each filter in the filter bank being configured to determine an energy of at least a portion of the input signal in a given frequency range; and wherein, for each frame, the matrix derived by the feature extraction block is an P×K matrix whose (i,j)th entry comprises the energy of the jth frame in the frequency band defined by the jth filter in the filterbank, and wherein the feature extraction block is configured to concatenate the rows of the matrix to form the supervector.

8. An audio processing system as claimed in claim 6, further comprising:

an energy detection block configured to process each frame into K sub-frames; and wherein the feature extraction block further comprises:

a filter bank comprising P filters, each filter in the filter bank being configured to determine an energy of at least a portion of the input signal in a given frequency range; and wherein, for each frame, the matrix derived by the feature extraction block is an K×P matrix whose (i,j)th entry comprises the energy of the ith frame in the frequency band defined by the jth filter in the filterbank, and wherein the feature extraction block is configured to concatenate the columns of the matrix to form the supervector.

9. An audio processing system as claimed in claim 1, further comprising:

a classification unit configured to determine a measure of difference between the or each supervector and an element stored in a dictionary, the element being stored as a vector representing the known sound event.

10. An audio processing system as claimed in claim 9 wherein, if the measure of difference between a given supervector and a vector in the dictionary representing the known sound event is below a first predetermined threshold, then the classification unit is configured to output a detection signal indicating that the known sound event has been detected for the portion of the input signal corresponding to the given supervector.

11. An audio processing system as claimed in claim 10 wherein, if a given number of supervectors for which the measure of difference is below the first predetermined threshold is above a second predetermined threshold, then the classification unit is configured to output a detection signal indicating that the known sound event has been detected for the portion of the input signal corresponding to the given number of supervectors.

12. An audio processing system as claimed in claim 9, wherein the classification unit is configured to represent the or each supervector in terms of a weighted sum of elements of a dictionary, each element of the dictionary being stored as a vector representing the known sound event, the dictionary storing the elements as a matrix of vectors, the classification unit thereby being configured to represent the or each supervector as a product of a weight vector and the matrix of vectors.

13. An audio processing system as claimed in claim 12, wherein vector entries in the dictionary matrix are grouped according to the type of known sound, and wherein the classification unit is configured to, for the or each supervector, determine an activated known sound type being the known sound type having the greatest number of vectors having non-zero coefficients when the or each supervector is represented as the weighted sum, the classification unit being configured to sum the coefficients of the vectors in the activated known sound type and compare the sum to a third predetermined threshold, and if the sum is greater than the third predetermined threshold then the classification unit is configured to output a detection signal indicating that the activated known sound type has been detected for the or each supervector.

14. An audio processing system as claimed in claim 12, wherein vector entries in the dictionary matrix are grouped according to the type of known sound, and wherein the classification unit is configured to, for the or each supervector, sum the coefficients of the vectors in each group according to each type of known sound to determine an activated known sound type being the known sound type whose vector coefficients have the highest sum, the classification unit being to compare the sum of the coefficients in the activated known sound type to a fourth predetermined threshold, and if the sum is greater than the fourth predetermined threshold then the classification unit is configured to output a detection signal indicating that the activated known sound type has been detected for the or each supervector.

15. An audio processing system as claimed in claim 13 wherein, the classification unit is to average the sum of the coefficients of the vectors in the activated known sound type, for each supervector, and to compare the average to a fifth predetermined threshold, wherein, if the average sum is greater than the fifth predetermined threshold then the classification unit is to configured to output a detection signal indicating that the activated known sound type has been detected for the audio signal.

16. An audio processing module for an audio processing system, the audio processing module being configured to receive an input signal representing an audio signal and to derive a feature matrix representing the audio signal, the module being configured to concatenate the rows or columns of the matrix to form a vector, each entry in the matrix representing an energy of a portion of the input signal in a given frequency range, the vector thereby representing the input signal, and to compare the vector to a stored vector representing a known sound event.

17. An audio processing module as claimed in claim 16, the audio processing module being configured to represent the vector as a weighted sum of elements in a dictionary, the elements being vectors representing the known sound event.

18. An audio processing module as claimed in claim 17, the audio processing module being configured to determine an activated portion of the dictionary, the activated portion being the portion of the dictionary having the greatest number of vectors with non-zero weights, and to cause a signal to be outputted, the signal indicating that the known sound event corresponding to the activated portion of the dictionary has been detected for the audio signal.

* * * * *